US008170429B2

(12) United States Patent
Nishikawa

(10) Patent No.: US 8,170,429 B2
(45) Date of Patent: May 1, 2012

(54) PRINTER OPERABLE IN TONER SAVING AND NON-SAVING MODES

(75) Inventor: Naoki Nishikawa, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 242 days.

(21) Appl. No.: 12/493,825

(22) Filed: Jun. 29, 2009

(65) Prior Publication Data

US 2010/0054764 A1 Mar. 4, 2010

(30) Foreign Application Priority Data

Aug. 28, 2008 (JP) ..... 2008-219192

(51) Int. Cl.
*G03G 15/08* (2006.01)

(52) U.S. Cl. ..... 399/27

(58) Field of Classification Search ..... 399/24, 399/27, 43, 61, 81, 258
See application file for complete search history.

(56) References Cited

U.S. PATENT DOCUMENTS

| | | | | |
|---|---|---|---|---|
| 5,546,170 | A * | 8/1996 | Ohba et al. | 399/58 |
| 7,003,234 | B2 * | 2/2006 | Itoh | 399/27 |
| 7,729,631 | B2 * | 6/2010 | Yamada | 399/85 |
| 7,738,800 | B2 * | 6/2010 | Yamada | 399/27 |
| 7,925,173 | B2 * | 4/2011 | Yamada | 399/27 |
| 2006/0204257 | A1 | 9/2006 | Kawano et al. | |

FOREIGN PATENT DOCUMENTS

| | | | |
|---|---|---|---|
| JP | 06350820 | A * | 12/1994 |
| JP | 2002-007081 | A | 1/2002 |
| JP | 2002-103753 | | 4/2002 |
| JP | 2002189386 | A * | 7/2002 |
| JP | 2005084055 | A * | 3/2005 |
| JP | 2005-178009 | | 7/2005 |
| JP | 2005321620 | A * | 11/2005 |
| JP | 2006-178330 | A | 7/2006 |
| JP | 2006-251180 | | 9/2006 |
| JP | 2006251180 | A * | 9/2006 |
| JP | 2006276058 | A * | 10/2006 |
| JP | 2007-79816 | | 3/2007 |
| JP | 2008-152138 | A | 7/2008 |

* cited by examiner

*Primary Examiner* — Robert Beatty
(74) *Attorney, Agent, or Firm* — Scully, Scott Murphy & Presser, PC

(57) ABSTRACT

In a printer, the image-forming unit performs an image-forming operation in one of a non-saving mode and a saving mode. An amount of the printing agent used in the saving mode is less than an amount of the printing agent used in the non-saving mode. The determining unit determines, based on the remaining amount of the printing agent in the accommodating unit and the remaining times the image-forming unit can perform the image-forming operation, whether the image-forming unit should perform the image-forming operation in the non-saving mode or the saving mode. The controlling unit controls the image-forming unit to perform the image-forming operation in the mode determined by the determining unit.

11 Claims, 9 Drawing Sheets

341

| Print Counter | Required Toner Amount |
|---|---|
| 301- | 40 |
| 201-300 | 30 |
| 101-200 | 20 |
| 51-100 | 10 |
| 1-50 | 5 |

PRINTER OPERABLE IN TONER SAVING AND NON-SAVING MODES

CROSS REFERENCE TO RELATED APPLICATION

This application claims priority from Japanese Patent Application No. 2008-219192 filed Aug. 28, 2008. The entire content of the priority application is incorporated herein by reference.

TECHNICAL FIELD

The present invention relates to a printer having a print restriction function.

BACKGROUND

Conventionally, a printer having a print restriction function for restricting printing operations by using a print counter is known. By controlling an amount of print based on the print restriction function, unnecessary printing can be prevented. Japanese laid open patent application publication No. 2002-103753 discloses a color printer having a function capable of controlling the number of sheets of paper to be printed on a user basis. Such a color printer retains the maximum number of sheets of paper to be printed respectively for color printing and monochrome printing. If the number of printed sheets reaches the maximum number, the color printer stops printing.

However, such a conventional printer has a problem as described below. Such a conventional printer has a print counter, and can perform a printing operation within a range of values permitted by the print counter. This tends to make an impression that the printing operation can be performed without any troubles if the printing operation is performed within the range of values permitted by the print counter. However, in fact, the printing operation may not be performed due to lack of developing agent, despite that the printing operation is performed within the range of values permitted by the print counter.

SUMMARY

It is therefore an object of the present invention to provide a printer that performs the printing operation for the number of sheets of paper as many as possible even if a remaining amount of developing agent is insufficient.

This and other objects of the present invention will be attained by providing a printer including an accommodating unit, a detecting unit, an image-forming unit, a counter that counts remaining times the image-forming unit can perform the image-forming operation, a determining unit, and a controlling unit. The accommodating unit accommodates printing agent for forming an image on a recording medium. The detecting unit detects a remaining amount of the printing agent in the accommodating unit. The image-forming unit performs an image-forming operation in one of a non-saving mode and a saving mode. An amount of the printing agent used in the saving mode is less than an amount of the printing agent used in the non-saving mode. The counter counts remaining times the image-forming unit can perform the image-forming operation. The determining unit determines, based on the remaining amount and the remaining times, whether the image-forming unit should perform the image-forming operation in the non-saving mode or the saving mode. The controlling unit controls the image-forming unit to perform the image-forming operation in the mode determined by the determining unit.

DETAILED DESCRIPTION

Next, a printer according to preferred embodiments of the present invention will be described while referring to the accompanying drawings. The present invention is applied to an electro-photographic type printer having a print restriction function.

First Embodiment

[Entire Structure of Printer]

Figure 1:
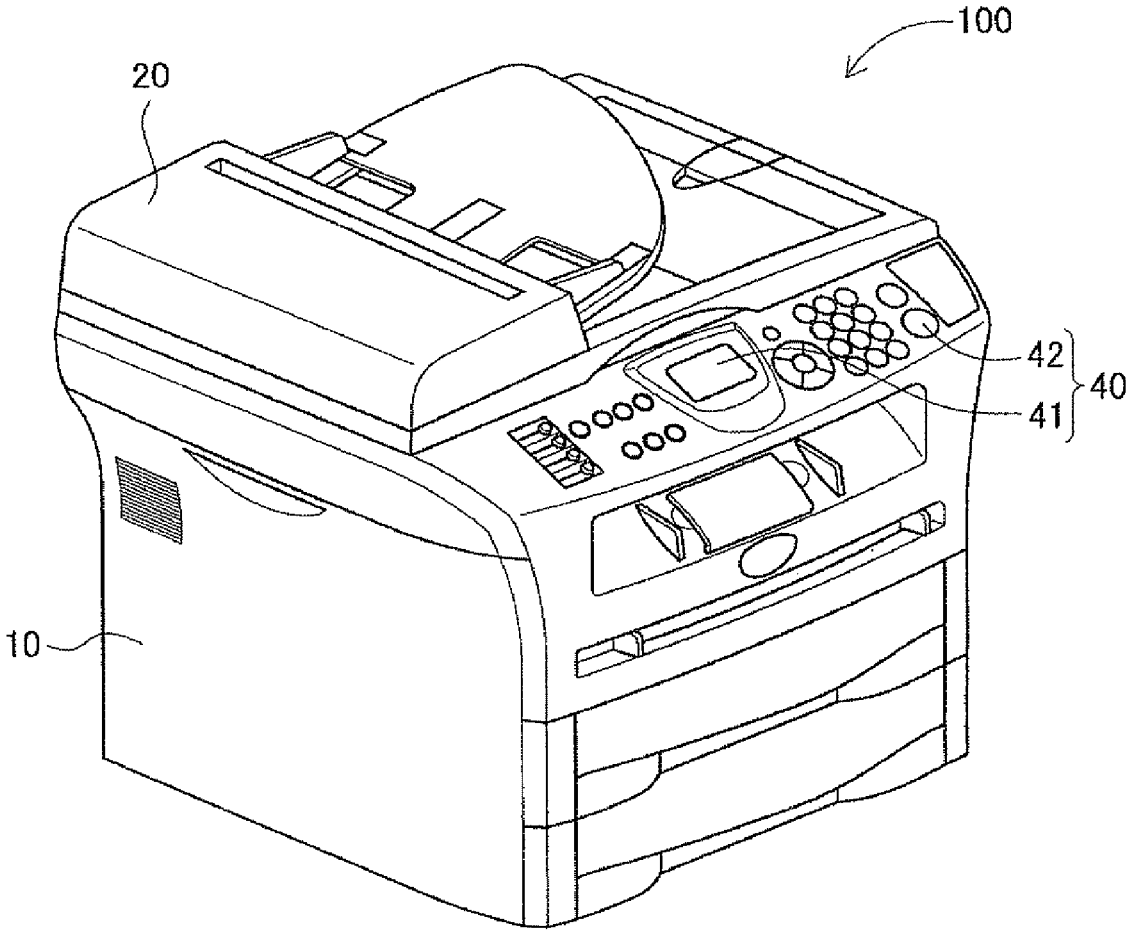
FIG. 1 is a perspective view of a printer according to a first embodiment of the present invention.

A printer 100 according to a first embodiment includes an image forming unit 10 for forming an image on a sheet of paper and a scanner unit 20 for reading an image on a document, as shown in FIG. 1. An operation panel 40 having a display unit 41 and buttons 42 is disposed in a front side of the scanner unit 20. The display unit 41 has a liquid crystal display. The buttons 42 include several keys, such as a start key, a stop key, and numeric keys. The operation panel 40 displays operating conditions and is operable by a user. The display unit 41 is capable of displaying a print counter as described below.

The printer 100 is connected to a personal computer (hereinafter referred to as "PC") via a network. A print request is outputted from the PC to the printer 100. The printer 100 performs a print process by receiving the print request. The printer 100 may be directly connected to the PC without involving the network.

[Structure of Image Forming Unit of Printer]

Figure 2:
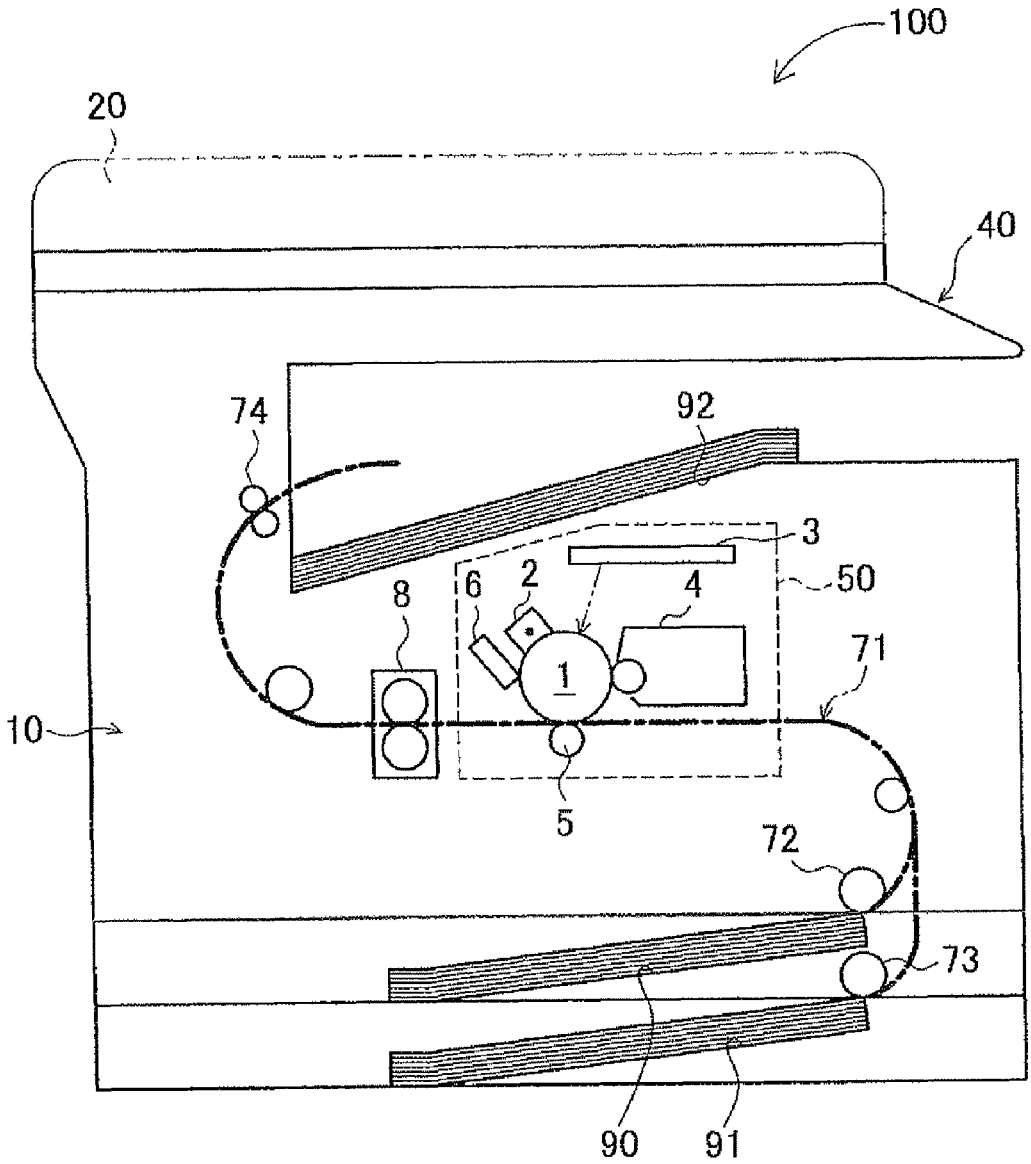
FIG. 2 is a schematic view showing a brief structure of an image forming unit of the printer.

The image forming unit 10 forms an image by a well-known electro-photographic system. As shown in FIG. 2, the image forming unit 10 includes a process unit 50 for forming a toner image, a fixing section 8 for fixing an unfixed toner image on a sheet of paper, sheet supply cassettes 90 and 91 for storing sheets of paper prior to forming images thereon, and a sheet discharge tray 92 for placing the sheets of paper after having formed images thereon. The sheet supply cassettes 90 and 91 are mounted in a lower section of the image forming unit 10. The sheet discharge tray 92 is disposed in an upper section of the image forming unit 10.

The image forming unit 10 has a generally S-shaped conveying path 735 so that the sheet of paper stored in the sheet supply cassettes 90 and 91 is conveyed to the sheet discharge tray 92 passing through sheet supply rollers 72 and 73, the process unit 50, the fixing section 8, and a sheet discharge roller 74. In other words, in the image forming unit 10, the sheets of paper stored in the sheet supply cassettes 90 and 91 are removed therefrom on a sheet basis and conveyed to tire process unit 50. A toner image formed in the process unit 50 is transferred onto the sheet. Further, the sheet on which the toner image has been transferred is conveyed to the fixing unit 8 and thermally fixed the toner image thereonto. Then, the sheet on which the toner image has been fixed is discharged to the sheet discharge tray 92.

The process unit 50 includes a photosensitive drum 1, a charging section 2 for uniformly charging a surface of the photosensitive drum 1, an exposing section 3 for irradiating the surface of the photosensitive drum 1 with light and forming an electrostatic latent image thereon, a developing section 4 for accommodating toner, developing the electrostatic latent image by the toner and detecting a remaining amount of the toner, a transfer section 5 for transferring the toner image formed on the photosensitive drum 1 onto the sheet of paper, and a cleaning blade 6 for removing residual toner from the surface of the photosensitive drum 1. The photosensitive drum 1, the charging section 2, the developing section 4, and the cleaning blade 6 constitute a process cartridge, and the process cartridge is detachably installable to a main frame of the printer 100.

In the process unit 50, the surface of the photosensitive drum 1 is uniformly charged by the charging section 2. Then, the surface is exposed by the light emitted from the exposing section 3, so that an electrostatic latent image corresponding to an image to be formed on the sheet of paper is formed on the surface. Then, the toner is supplied to the photosensitive drum 1 through the developing section 4. Therefore, a visible toner image corresponding to the electrostatic latent image can be formed on the surface of the photosensitive drum 1.

[Electrical Structure of Printer]

Figure 3:
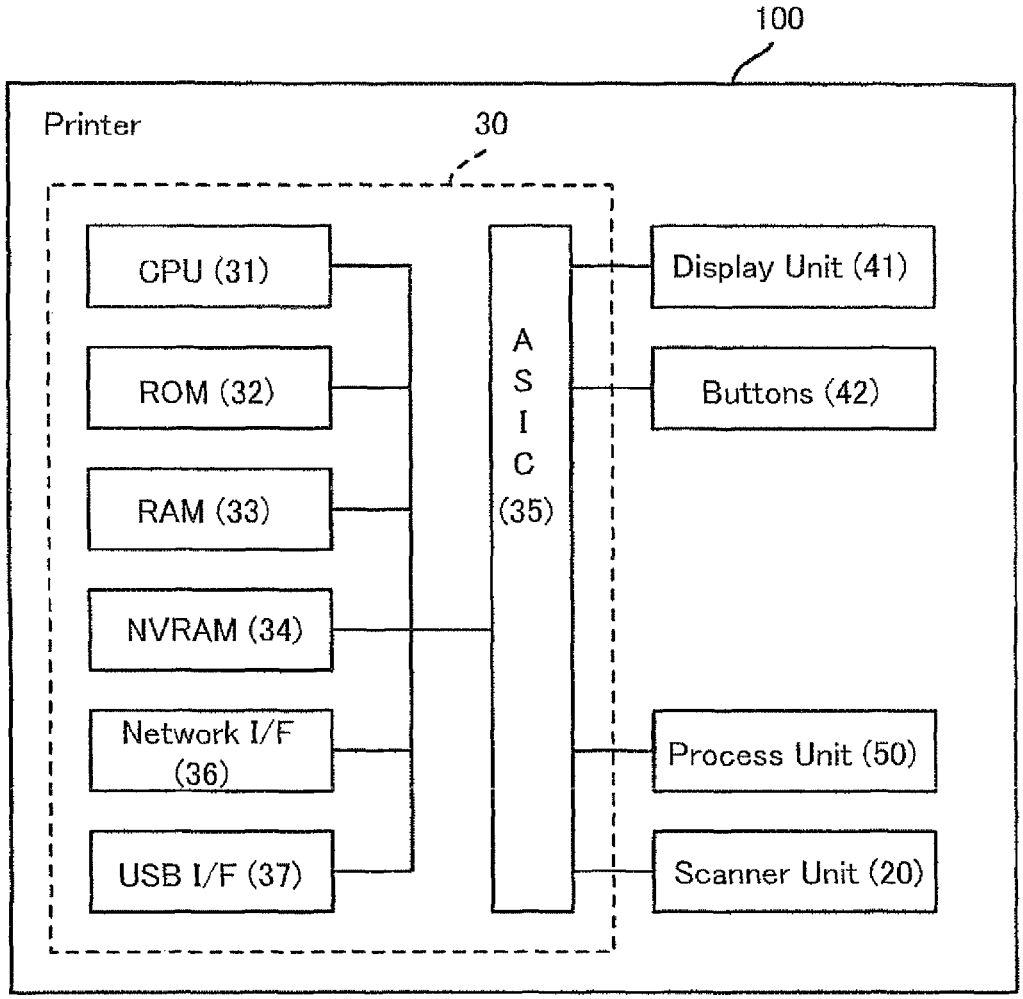
FIG. 3 is a block diagram showing an electrical structure of the printer.

Next, an electrical structure of the printer 100 will be described. As shown in FIG. 3, the printer 100 is provided with a control section 30 having a CPU 31, a ROM 32, a RAM 33, an NVRAM (nonvolatile RAM) 34, an ASIC 35, a network interface 36, and a USB interface 37.

The ROM 32 stores several control programs, settings, and initial values for controlling the printer 100. The RAM 33 serves as a work area for reading out the control programs and a storage area for temporarily storing image data.

The NVRAM 34 stores the maximum number of sheets of paper to be printed per day and a print counter. The print counter is decremented by one per sheet of paper when printing. When the print counter indicates zero, no further printing operation can be performed. In other words, a value of the print counter is equivalent to the number of remaining printable sheets of paper. The value of the print counter is reset each time a predetermined period of time, such as a day and a month, has elapsed, and the value of the print counter is again set to the maximum number of sheets of paper to be printed.

Figures 4, 5:
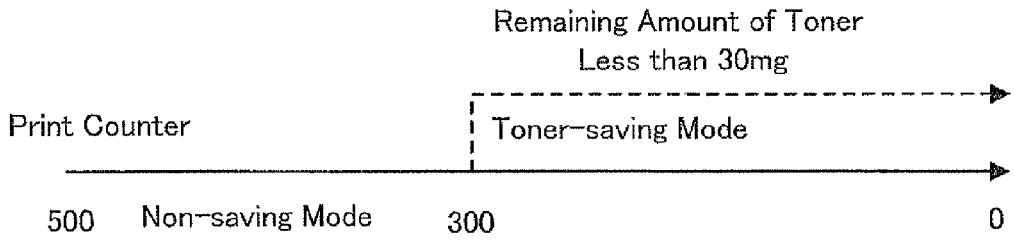
FIG. 4 is a table showing an example of an estimated required toner amount table defining a required amount of toner corresponding to the number of remaining printable sheets of paper.
FIG. 5 is an explanatory diagram showing an example how to shift a print mode in a print restriction process.

Further, the NVRAM 34 stores a table (hereinafter referred to as "estimated required toner amount table") defining a minimum remaining amount of toner (hereinafter referred to as "required toner amount") corresponding to the value of the print counter (equivalent to the number of the remaining printable sheets of paper). The required toner amount is used for determining whether or not the remaining amount of toner is low relative to the value of the print counter. According to the present embodiment, as shown in FIG. 4, an estimated required toner amount table 341 is provided to define the required toner amount for each predetermined value of the print counter.

The ASIC 35 is electrically connected to the process unit 50, the scanner unit 20, the display unit 41, and the buttons 42. While processing the control programs read out from the ROM 32 and controlling to store processing results in the RAM 33 and the NVRAM 34, the CPU 31 controls each components of the printer 100 (for example, a drive motor (not shown) of several rollers constituting the conveying path 71 and a motor for moving an image sensor unit constituting the scanner unit 20) through the ASIC 35.

The network interface 36 and the USB interface 37 are connected to an information processing device. The network interface 36 and the USB interface 37 enable the printer 100 and the information processing device to transmit data reciprocally.

[Operation in Print Restriction Process]

Next, a shifting operation of a print mode under a print restriction process will be described. The printer 100 according to the present embodiment has a non-saving mode and a toner-saving mode as print mode. Under the non-saving mode, an amount of toner to be consumed is not restrained and a normal printing operation is performed. Under the toner-saving mode, the amount of toner to be consumed is restrained compared with the non-saving mode and the printing operation is performed with the restrained amount of toner. In the printer 100, the print modes are shifted from the non-saving mode to the toner-saving mode by comparing the required toner amount corresponding to the value of the print counter with an actual remaining amount of toner in a toner cartridge.

For example, as shown in FIG. 5, if five hundred sheets of paper are set as the maximum, number of sheets of paper to be printed per day, an initial value of the print counter is set to 500. In a condition that the remaining amount of toner is sufficient, the printing operation is performed in the non-saving mode (solid arrow in FIG. 5). If the remaining amount of toner remains sufficient, the printing operation is performed in the non-saving mode until the print counter indicates zero. However, if the remaining amount of toner becomes insufficient, for example, if the remaining amount of toner is less than 30 mg when the value of the print counter is 300, and if the printing operation is repeatedly performed by the non-saving mode, the toner may be running out shortly, it is highly likely that no further printing operation can be performed before the value of the print counter reaches zero. Accordingly, the print mode is shifted to the toner-saving mode when the remaining amount of toner is determined to be insufficient (dashed arrow in FIG. 5).

[Print Processing]

Figure 6:
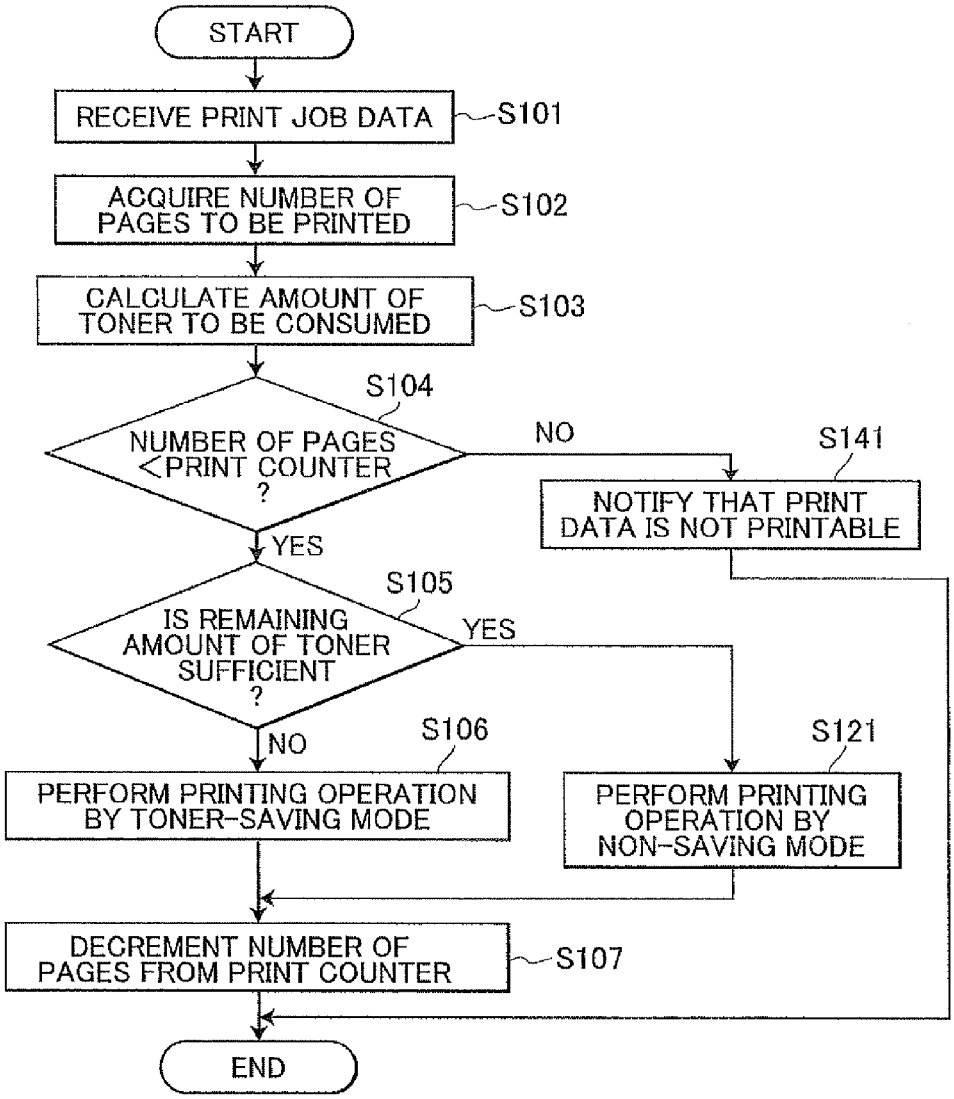
FIG. 6 is a flowchart showing steps of a print restriction process according to the first embodiment.

Print processing performed by the CPU 31 under the above described print restriction process will be described with reference to the flowchart shown in FIG. 6. The print processing is executed each time a print job is received by the printer 100.

Firstly, the CPU 31 receives print job data (S101). The received print job data contains several settings other than print data, such as designated tray, paper size, print direction and print quality.

Next, the CPU 31 acquires the number of pages to be printed from the received print job data (S102). The print data in the print job data contains one or more files, and each file is formed on a page basis. "The number of pages to be printed" referred to here is equivalent to the number of times that the process unit 50 forms images. Then, the CPU 31 calculates the amount of toner to be consumed based on the received print job data (S103). The processes in S102 and S103 may be executed in reverse order.

Next, the CPU 31 determined whether or not the received print job data is printable (S104). More specifically, if the number of the pages to be printed acquired in S102 is less than the value of the print counter, the CPU 31 determines that the received print job data is printable. If the received print job data is not printable (S104: NO), the CPU 31 notifies that the received print job data is not printable (S141), and the printing operation is canceled. Thus, the routine of the print processing then ends. As a method of notification, for example, indication in the display unit 41 and emitting of an alert sound are conceivable.

The remaining amount of toner can be calculated, for example, based on a presumed total amount of toner to be consumed. The presumed total amount of toner to be consumed is obtained by a stored amount of toner when the toner cartridge is filled with the toner, and accumulating the number of dots contained in images printed by the time. In addition, other publicly known methods may be used to obtain the remaining amount of toner.

If the received print job data is printable (S104: YES), the CPU 31 determines whether or not the remaining amount of toner is sufficient (S105). More specifically, the CPU 31 acquires the required toner amount corresponding to the value of the print counter by referring to the estimated required toner amount table 341, and determines that the remaining amount of toner is sufficient if the remaining amount of toner is greater than the required toner amount. For example, if the value of the print counter is 300, the required toner amount is 30 mg. If the actual remaining amount of toner is greater than 30 mg, the remaining amount of toner is determined to be sufficient. If the actual remaining amount of toner is less than 30 mg, it is presumed that the remaining amount of toner is insufficient. Note that the CPU 31 may estimate an required amount based on types of the print data (character, photograph and the like) and the settings, such as the paper size and the print quality, instead of referring to the estimated required toner amount table 341.

If the remaining amount of toner is sufficient (S105: YES), the CPU 31 performs the printing operation in the non-saving mode (S121). However, if the remaining amount of toner is not sufficient (S105; NO), the CPU 31 performs the printing operation in the toner-saving mode for restraining the amount of toner to be consumed (S106). In the toner-saving mode according to the present embodiment, development efficiency of the developing section 4 is lowered by reducing developing bias, so that a density of an image to be printed is lowered than that of an image to be printed by the non-saving mode. The density is set to an appropriate value based on the remaining amount of toner and the estimated amount of toner to be consumed. Consumption of toner can be reduced by setting the density to a low value.

The density may be calculated and set based on the estimated amount of toner to be consumed, and may be set as a fixed value stored for the toner-saving mode. Further, a method of reducing the amount of toner to be consumed is not limited to changes in the density. For example, dot skipping and printing in reduced size are also conceivable. Further, in case of a color printer, a color of which toner consumption should be reduced may be substituted for a different color when printing.

Subsequent to the processes in S106 and S121 and the CPU 31 decrements the print counter by the number of the printed pages (S107). That is, the number of the printed pages is subtracted from the present value of the print counter. Subsequent to the process in S107, the CPU 31 ends the print processing.

In the conventional printer, the amount of toner to be consumed varies depending on types of images to be printed. In other words, even if 1 is subtracted from the value of the print counter, the amount of toner to be consumed differs greatly, for example, between printing of a solid image and that of a text image. Since it is not possible to anticipate future print jobs to be executed, accurate consumption tendency of the toner cannot be obtained.

In the printer 100 according to the present embodiment, whether or not a remaining amount of consumable toner is insufficient relative to the required toner amount corresponding to the value of the print counter is determined. That is, a possibility that the value of the print counter cannot reach zero is detected before the toner is running out. Further, if it is detected that the remaining amount of consumable toner is insufficient relative to the value of the print counter, the print mode is shifted to the toner-saving mode from the non-saving mode, and the printing operation is performed by the toner-saving mode in a low density. Accordingly, the toner consumption can be reduced, and reduction of the toner consumption results in performing more printing operations.

Second Embodiment

Next, a printer according to a second embodiment will be described. The printer according to the second embodiment performs a printing operation adjusting a density of an image to be printed on a page basis when the printing operation is performed by the toner-saving mode. In other words, the printer according to the second embodiment is capable of setting multistep adjustment of the density for restraining the toner consumption. In this point, the second embodiment is different from the first embodiment of which the printer performs the printing operations in the predetermined density which is set when the print mode is shifted to the toner-saving mode. The structure of the printer according to the second embodiment is the same as that of the printer according to the first embodiment. Accordingly, an explanation of the structure of the printer according to the second embodiment is omitted.

[Print Processing]

Figure 7:
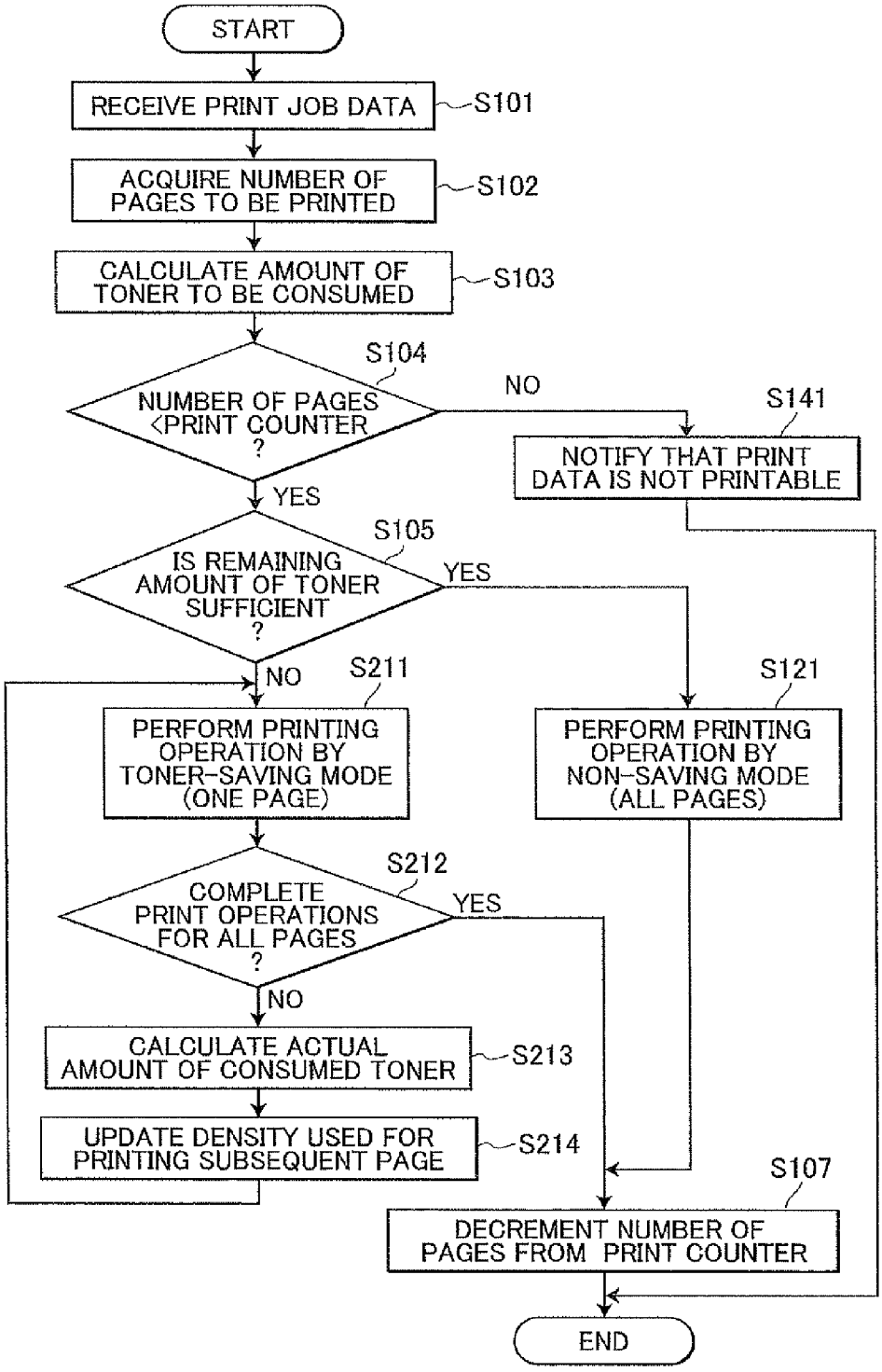
FIG. 7 is a flowchart showing steps of a print, restriction process according to a second embodiment.

Print processing according to the second embodiment will be described while referring to the flowchart shown in FIG. 7. In the flowchart, in respect of the print processing the same as that in the first embodiment, the same reference numerals are assigned and an explanation is omitted.

In the print processing according to the present embodiment, if the remaining amount of toner is determined to be insufficient (S105: NO), the CPU 31 performs the printing operation in the toner-saving mode (S211). More specifically, the CPU 31, firstly, in the same manner as the first embodiment, sets a density of an image to be printed to an appropriate value based on the actual remaining amount of toner and the estimated amount of toner to be consumed, and performs the printing operation for one page to be printed in the set density.

Secondly, the CPU 31 determines whether or not all the pages to be printed have been printed (S212). If all the pages to be printed have not yet been printed (S212: NO), the CPU 31 calculates an actual amount of consumed toner based on such as the density tire image contained in the printed page, and the number of the dots of the image contained in the printed page (S213). Then, the CPU 31 recalculates an appropriate density based on the actual amount of consumed toner in order to update the density used for printing the previous page that has been printed (S214). Then, the CPU 31 returns to S211 in order to set a density of an image to be printed to an appropriate value and perform the printing operation for one page to be printed in the set density. However, if all the pages to be printed have been printed (S212: YES), the CPU 31 counts the print counter by the number of the printed pages (S107). The CPU 31 ends the print processing.

The printer according to the present embodiment is capable of setting the multistep adjustment of the density for restraining the toner consumption, and updates the density by recalculating the appropriate density during the printing operations performed by the toner-saving mode. That is, a feedback control of the density is performed. Hence, compared to the first embodiment, degradation of the print quality accompanied by lowering the density of the image can be balanced with the restraint of the toner consumption in the second embodiment. For example, making a great impact on the print quality by excessive restraint of the toner consumption can be avoided. Further, if the actual remaining amount of toner becomes close to the required toner amount corresponding to the value of the print counter by performing the printing operations with adjusting the density, the density is updated to be higher so that the print quality can be improved. In such case, the CPU 31 will return to S105 after S214. Further, by performing the feedback control of the density, an appropriate toner saving process relative to the actual remaining amount of toner can be performed.

Third Embodiment

Next, a printer according to a third embodiment will be described. The printer according to the third embodiment confirms that a user requires a printing operation to be performed by the toner-saving mode prior, before shifting to the toner-saving mode. In this point, the present embodiment differs from the first embodiment of which the printer automatically shifts to the toner-saving mode without confirming the requirement of the user, if the remaining amount of toner is insufficient. The structure of the printer according to the third embodiment is the same as that of the printer according to the first embodiment. Accordingly, an explanation about the structure of the printer according to the third embodiment is omitted.

[Print Processing]

Figure 8:
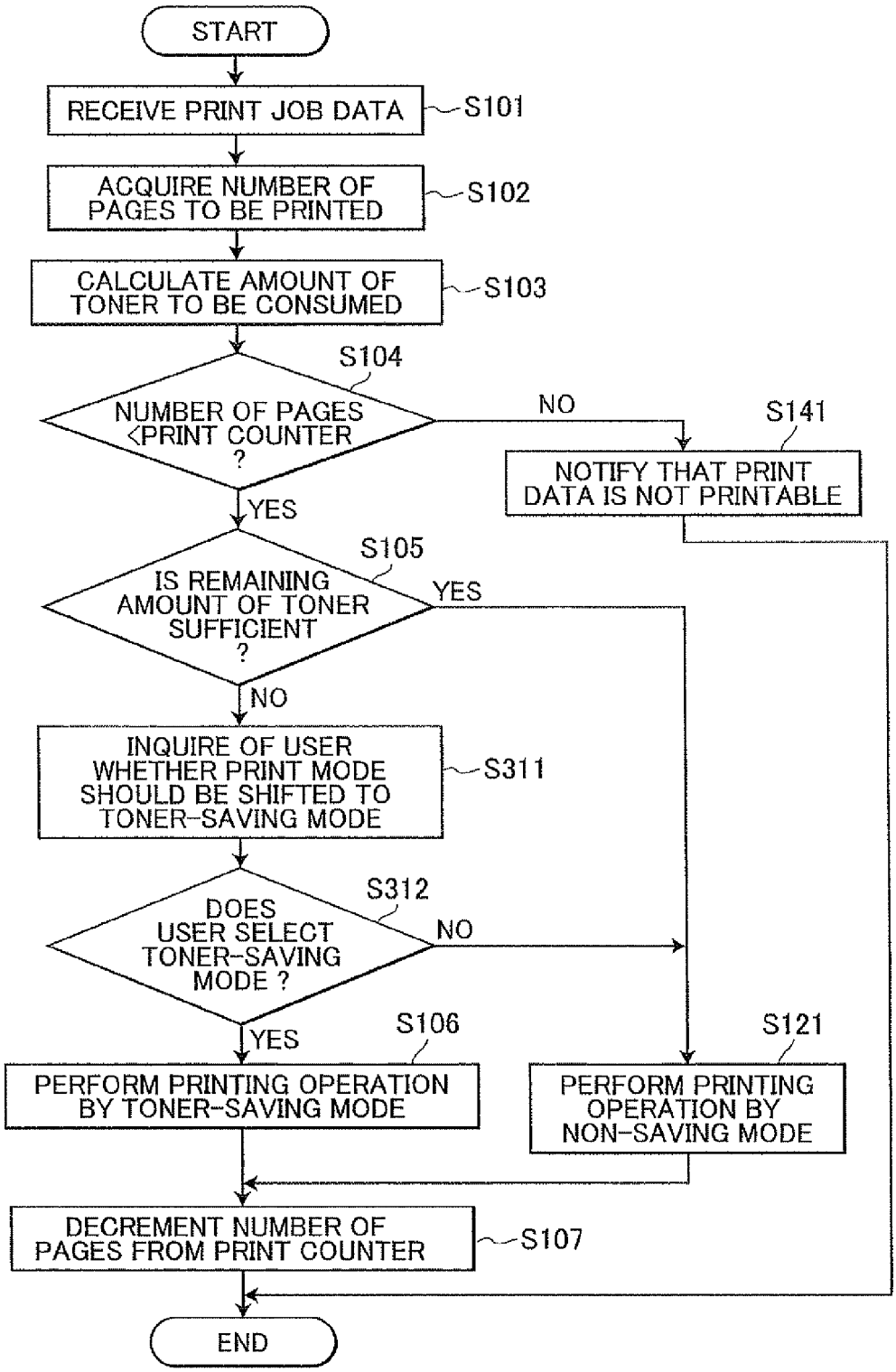
FIG. 8 is a flowchart showing steps of a print restriction process according to a third embodiment.

Print processing according to the third embodiment will be described while referring to the flowchart shown in FIG. 8. In the flowchart, in respect of the print processing the same as that in the first embodiment, the same reference numerals are assigned and an explanation is omitted.

Figure 9:
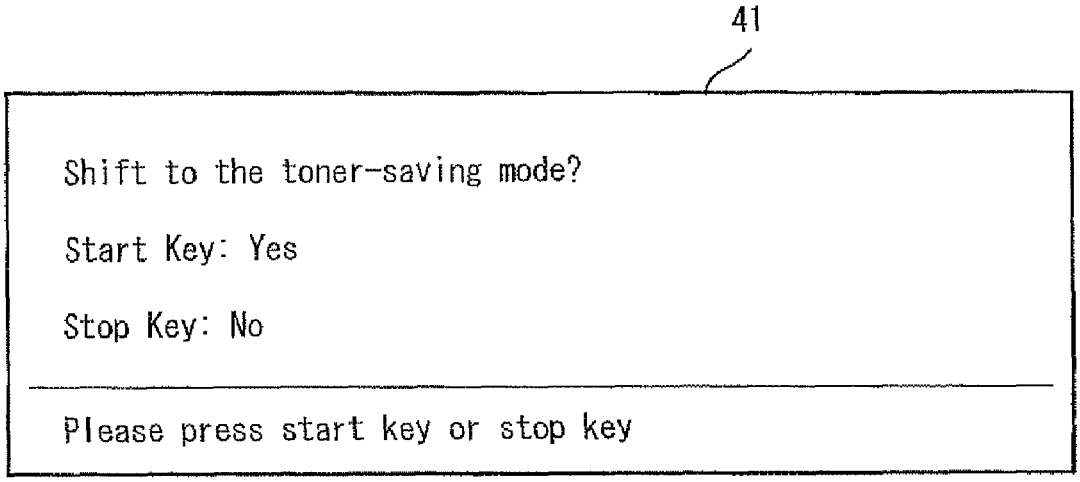
FIG. 9 shows an example of a display to inquire of a user whether or not the print mode should be shifted to a toner-saving mode.

In the print processing according to the present embodiment, if the remaining amount of toner is determined to be insufficient (S105: NO), the CPU 31 inquires of the user whether or not the print mode should be shifted to the toner-saving mode (S311). According to the present embodiment, as shown in FIG. 9, for example, a display to inquire of the user whether the print mode should be shifted to the toner-saving mode is displayed in the display unit 41 of the printer 100. In this time, the start key serves as a trigger for selecting the toner-saving mode, and the stop key serves as a trigger for maintaining the non-saving mode. A signal for inquiring of the user whether or not the print mode should be shifted to the toner-saving mode may be outputted to the PC from which the print job is transmitted.

Next, the CPU 31 determines whether or not the user selects to shift to the toner-saving mode (S312). If the user selects to shift to the toner-saving mode (S312: YES), the CPU 31 performs the printing operation in the toner-saving mode (S106). However, if the user does not select to shift to the toner-saving mode (S312: NO), the CPU 31 performs the printing operation in the non-saving mode (S121).

In the printer according to the present embodiment, prior to shifting to the toner-saving mode, an inquiry whether or not the print mode should be shifted to the toner-saving mode is made. While the printing operation may be performed by the toner-saving mode, the non-saving mode may be maintained for further printing operations. That is, the user can choose whether the print mode should be shifted to the toner-saving mode in order to increase the number of sheets of paper to be printed or the non-saving mode is maintained in order to maintain the print quality. Further, since the print mode is shifted to the toner-saving mode after the user has chosen the print mode, the user can recognize that the print mode is shifted to the toner-saving mode. Thus, user's distrust of the printer that the printing operation is performed in low density can be avoided.

In the present embodiment, if the user does not select to shift to the toner-saving mode, the printing operation is performed by the non-saving mode. However, the printing operation may be canceled if the user does not select to shift to the toner-saving mode. Further, the user may choose whether the printing operation is cancelled or is performed by the non-saving mode, in case the user does not select to shift to the toner-saving mode.

Fourth Embodiment

Next, a printer according to a fourth embodiment will be described. The printer according to the fourth embodiment avoids shifting to the toner-saving mode when the remaining amount of toner is nearly equal to the amount of toner when the toner cartridge is almost full of the toner. That is, the printer according to the present embodiment avoids shifting to the toner-saving mode immediately after the toner cartridge has been replaced with new one. In this point, the present embodiment differs from the first embodiment of which the printer has a possibility to shift to the toner-saving mode even if the toner cartridge has just been replaced. The structure of the printer according to the fourth embodiment is the same as that of the printer according to the first embodiment. Accordingly, an explanation about the structure of the printer according to the fourth embodiment is omitted.

[Print Processing]

Figure 10:
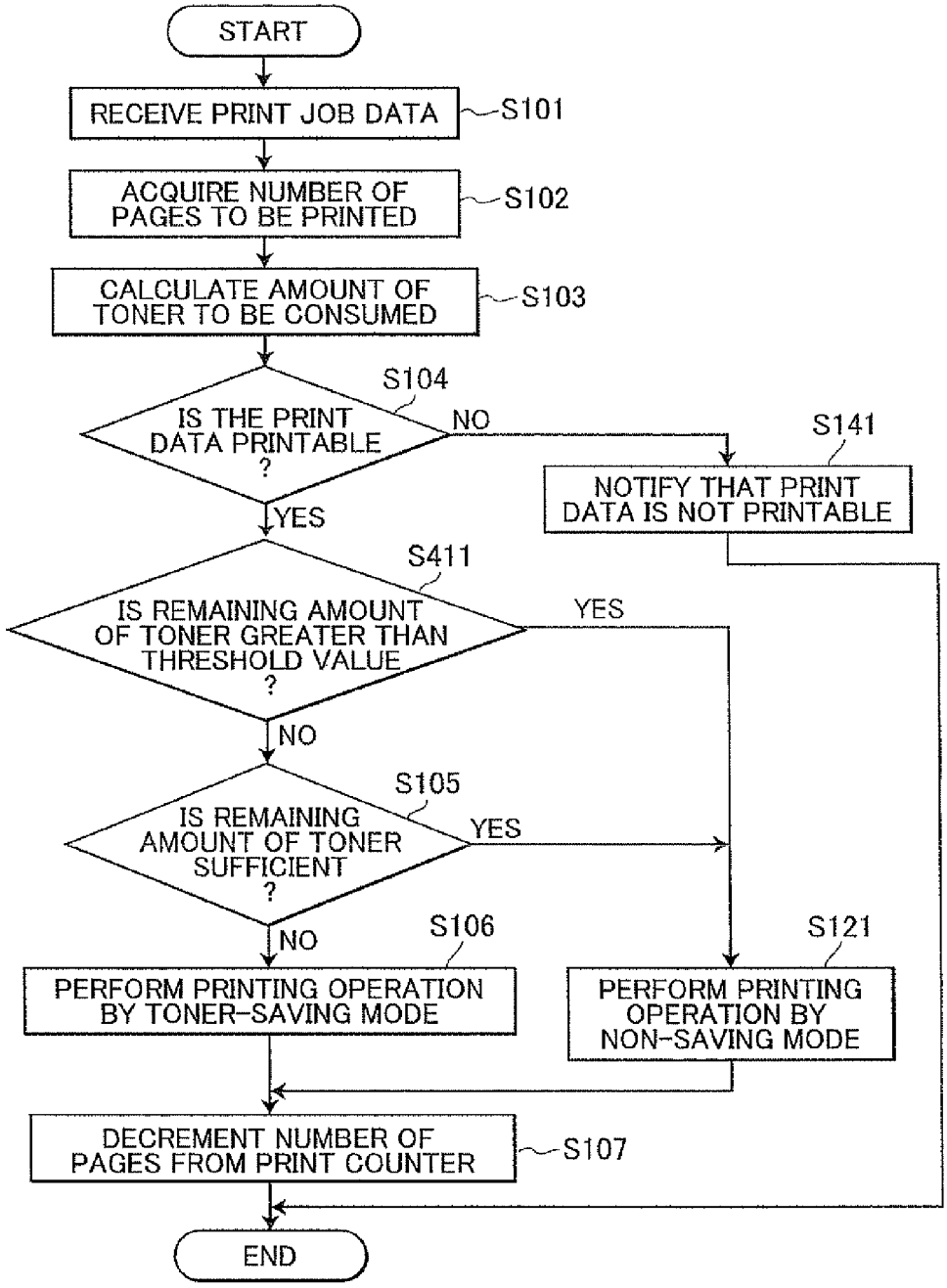
FIG. 10 is a flowchart showing steps of a print restriction process according to a fourth embodiment.

Print processing according to the fourth embodiment will be described while referring to the flowchart shown in FIG. 10. In the flowchart, in respect of the print processing the same as that in the first embodiment, the same reference numerals are assigned and an explanation is omitted. The print processing according to the present embodiment, a threshold value is preliminarily set as a reference for determining whether or not the remaining amount of toner is equal to the amount of toner when the toner cartridge is filled with the toner.

In the print processing according to the present embodiment, if the received print job data is printable (S104: YES), the CPU 31 determines whether or not the actual remaining amount of toner is greater than the threshold value (S411). If the remaining amount of toner is greater than the threshold value (S411: YES), the CPU 31 performs the printing operation in the non-saving mode (S121) without determining whether or not the remaining amount of toner is sufficient (S105). However, if the remaining amount of toner is less than the threshold value (S411: NO), the CPU 31 determines whether or not the remaining amount of toner is sufficient, in the same manner as the first embodiment (S105). If the remaining amount of toner is sufficient (S105: YES), the CPU 31 performs the printing operation in the non-saving mode (S121). If the remaining amount of toner is not sufficient (S105: NO), the CPU 31 performs the printing operation in the toner-saving mode (S106).

In the printer according to the present embodiment, if the remaining amount of toner is greater than the threshold value preliminarily defined, the printing operation is forcibly performed by the non-saving mode. Therefore, if the remaining amount of toner is nearly equal to the amount of toner when the toner cartridge is almost full of the toner, the print mode is not allowed to shift to the toner-saving mode. In other words, if the remaining amount of toner is sufficient, maintaining the print quality prevails over the restraint of the toner consumption. Thus, it is not preferable to shift to the toner-saving mode. As an example that the remaining amount of toner is sufficient, a situation that a new or nearly new toner cartridge is used is considered. If the printing operation is performed in the toner-saving mode in such a situation, it may invite user's distrust of the printer. Thus, avoiding shifting to the toner-saving mode when the toner cartridge is new results in avoiding such user's distrust.

As described in detail above, the printer 100 according to the above embodiments performs the printing operation in the toner-saving mode to restrain the amount of toner to be consumed. Further, the printer 100 determines to shift to the toner-saving mode based on the remaining amount of toner (the remaining amount of the consumable toner). That is, if the printer 100 determines, based on the remaining amount of the consumable toner, that the toner is insufficient, the print mode is shifted to the toner-saving mode so as to restrain the toner consumption. Compared with the printing operation of which the print mode maintains the non-saving mode, the amount of consumed toner can be reduced and more printing operations can be performed when printing by the toner-saving mode. As a result, the print counter can be decremented as much as possible. The problem that the value of the print counter which should be counted to reach zero excessively remains can be solved.

Further, the printer 100 according to the above embodiments is provided with the estimated required toner amount table 341 to define the required toner amount (the estimated required toner amount) which is the threshold value in determining that the remaining amount of toner is insufficient. Further, the printer 100 determines whether or not the print mode should be shifted to the toner-saving mode by comparing the required toner amount with the actual remaining amount of toner. Accordingly, the printer 100 can detect that the remaining amount of toner is assumed to be insufficient, and shift the print mode to the toner-saving mode upon detecting such a condition. In other words, the toner consumption can be restrained before the toner has actually been insufficient. Accordingly, compared with a case that the print mode is shifted, to the toner-saving mode after the toner has actually been insufficient, the print counter can be decremented as many as possible.

While the invention has been described in detail with reference to specific embodiments thereof, it would be apparent to those skilled in the art that many modifications and variations may be made therein without departing from the scope and spirit of the invention. For example, the present invention can be applied to several types of device having a print function, such as a multifunction device and a copying machine, other than a printer. Further, the present invention is not only available for the image forming unit of electro-photographic type, but also for an image forming unit of ink jet type. The image forming system may be capable of forming color images, or forming only monochromatic images.

Further, in the above described embodiments, the print counter is controlled on a printer basis. However, for example, the print counter may be set on a user basis. In addition, the maximum number of sheets of paper to be printed and the amount of consumable toner may be set on a user basis. In this case, the printer determines whether or not the print mode is shifted to the toner-saving mode based on the amount of consumable toner assigned to each user. That is, even if the actual remaining amount of toner is sufficient, when the amount of consumable toner assigned to each user becomes insufficient, the print mode is shifted to the toner-saving mode so that the toner consumption can be restrained.

Further, in the above described embodiments, the actual remaining amount of toner in the toner cartridge is defined as the remaining amount of consumable toner. However, it is not limited to this. If the amount of consumable toner per day is defined, the remaining amount of consumable toner can be calculated by subtracting the amount of toner consumed by the printing operations on the day from the amount of consumable toner.

What is claimed is:

1. A printer comprising:

an accommodating unit that accommodates printing agent for forming an image on a recording medium;

a detecting unit that detects a remaining amount of the printing agent in the accommodating unit;

an image-forming unit that forms an image on a sheet in one of a non-saving mode and a saving mode, an amount of the printing agent used in the saving mode being less than an amount of the printing agent used in the non-saving mode;

a counter that counts the remaining number of sheets on which an image is to be formed by the image-forming unit;

a controlling unit; and a memory having machine readable instructions thereon that, when executed by the controller, perform the steps of:

stopping forming of the image by the image-forming unit if the number of sheets counted by the counter becomes a predetermined number;

calculating an amount of the printing agent required for the image-forming unit to form images in the non-saving mode on the remaining number of sheets counted by the counter;

controlling the image-forming unit to form images on sheets in the non-saving mode if the remaining amount detected by the detecting unit is larger than the calculated amount; and controlling the image-forming unit to form images on sheets in the saving mode if the remaining amount detected by the detecting unit is less than the calculated amount.

2. The printer according to claim 1, further comprising a storing unit that stores a required amount of the printing agent for the image-forming unit to perform the image-forming operation the remaining times, wherein the controlling unit determines that the image-forming unit should perform the image-forming operation in the saving mode, if the remaining amount is less than the required amount.

3. The printer according to claim 2, wherein the controlling unit controls the image-forming unit to perform the image-forming operation in the non-saving mode even if the controlling unit determines that the image-forming unit should perform the image-forming operation in the saving mode, when the remaining amount is larger than a predetermined amount.

4. The printer according to claim 1, wherein the image-forming unit performs, in the non-saving mode, the image-forming operation at a first density of the printing agent, and performs, in the saving mode, the image-forming operation at a second density of printing agent lower than the first density.

5. The printer according to claim 1, wherein the saving mode includes a plurality of saving modes, an amount of the printing agent used in the each saving mode being different from one another, wherein the controlling unit further selects, based on the remaining amount and the remaining times, one of the plurality of saving modes, if the controlling unit determines that the image-forming unit should perform the image-forming operation in the saving mode.

6. The printer according to claim 5, wherein the controlling unit determines one of the plurality of saving modes every time the image-forming unit performs the image-forming operation.

7. The printer according to claim 1, further comprising a selecting unit via which a user can select one of the non-saving mode and the saving mode, wherein the controlling unit controls the image-forming unit to perform the image-forming operation in the mode selected by the user regardless of the determination of the controlling unit.

8. The printer according to claim 1, wherein the image-forming unit is an electro-photography type image forming unit, and the printing agent is a toner for use with the electro-photography type image forming unit.

9. The printer according to claim 4 wherein the controlling unit readjusts the second density each time the image-forming operation is performed until the last image-forming operation is performed.

10. The printer according to claim 9 wherein the readjustment is based on the amount of printing agent used each time the image-forming operation is performed.

11. The printer according to claim 10 wherein the controlling unit switches from the saving mode to the non-saving mode based on the readjustment of the second density.

* * * * *